US006345626B1

(12) United States Patent
Bouix

(10) Patent No.: US 6,345,626 B1
(45) Date of Patent: Feb. 12, 2002

(54) MASCARA APPLICATOR HAVING COMPRESSIBLE ARRAY OF DISCS

(75) Inventor: Herve F. Bouix, New York, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/621,391

(22) Filed: Jul. 21, 2000

(51) Int. Cl.[7] ..... A45D 40/26
(52) U.S. Cl. ..... 132/218; 401/127
(58) Field of Search ..... 132/216, 218, 132/313, 317, 318, 320; 15/223, 224, 209.1, 211; 401/126, 127, 129, 122

(56) References Cited

U.S. PATENT DOCUMENTS 2,515,094 A * 7/1950 Price ..... 132/153
3,892,248 A * 7/1975 Kingsford ..... 132/88.7
3,930,280 A * 1/1976 Vasas ..... 15/257.05
3,998,235 A * 12/1976 Kingsford ..... 132/88.5
4,411,282 A * 10/1983 Wavering ..... 132/88.5
4,527,575 A * 7/1985 Vasas ..... 132/88.7
5,722,436 A * 3/1998 Vandromme et al. ..... 132/218
5,826,600 A * 10/1998 Rowe et al. ..... 132/317
6,158,912 A * 12/2000 Miraglia et al. ..... 401/129
6,260,558 B1 * 7/2001 Neuner ..... 132/218

* cited by examiner

*Primary Examiner*—Todd E. Manahan
*Assistant Examiner*—David C. Comstock
(74) *Attorney, Agent, or Firm*—Kenyon & Kenyon

(57) ABSTRACT

A cosmetic applicator which has an array of independent discs which compress during withdrawal from a container so that excess product can be removed from the applicator by a wiper. After passage through the wiper, the discs return to their expanded position by the action of a spring. The compressing of the discs during withdrawal allows a controlled amount of product to remain on the applicator for application by the consumer, and the returning of the discs to their expanded position by the spring causes the discs to assume a configuration which allows the applicator to effectively comb and separate the eyelashes.

9 Claims, 7 Drawing Sheets

MASCARA APPLICATOR HAVING COMPRESSIBLE ARRAY OF DISCS

FIELD OF THE INVENTION

The present invention relates to applicators for mascara or similar pasty products. More particularly, the present invention relates to mascara applicators that employ means other than bristles for the application of the mascara product to the consumer's eyelashes.

BACKGROUND OF THE INVENTION

A conventional mascara brush typically consists of an intertwisted wire core with a plurality of regularly disposed bristles extending radially from the wire core in a helical array. See, for example, U.S. Pat. Nos. 4,632,136, 4,733,425, 4,861,179, 4,887,622, 4,898,193, 4,927,281, 4,974,612, 4,993,440, 5,197,497, 5,238,011, 5,370,141, 5,542,439 and 5,588,450.

This mascara brush is then attached to a handle. The handle is then attached to, or is an integral part of, a closure. This closure, when placed on a container, engages the neck of the container to seal the brush within the container's internal chamber which contains the mascara product.

In use, the consumer removes the closure from the container, and thus also removes the brush from the internal chamber of the container. As the brush containing the mascara product is removed from the container it must first pass through a wiper contained within the neck of the container. The wiper removes excess product from the bristles of the brush so that an excessive amount of product is not present when the consumer tries to apply the product to her eyelashes.

There may be certain drawbacks to these types of mascara applicators. Namely, the relationship between the wiper and the brush is not always ideal, in that, the wiper orifice by design, cannot effectively scrape the product from the brush to leave an optimum amount of product on the brush for application by the consumer. This is because the diameter of the wiper orifice is such that the center region of the brush, i.e., the twisted wire core, is not wiped, thus causing an excessive build-up of product along the core.

If, however, the diameter of the wiper orifice is made smaller so as to reach and wipe the core of the brush, other problems are encountered which may impede the combing characteristics of the brush. For example, the bristles of the brush may become matted down along the core due to the increased force on the bristles as they pass by the smaller wiper orifice. Also, the reduced diameter of the wiper orifice may cause too much product to be removed from the edges of the bristles, thereby not leaving enough product available for application to the eyelashes.

U.S. Pat. No. 4,411,282 to Wavering discloses a mascara applicator which comprises a series of edge-tapered ring-like discs which are disposed as an axial array along a rod-like wand. The array of discs remain stationary relative to the rod, but the discs have flexible marginal edges and define annular grooves therebetween. As the applicator is withdrawn from the container, the discs pass through a wiping ring. Upon passage through the wiping ring the discs are flexed or deformed, and excess mascara is removed. The drawbacks to this type of flexible applicator generally leads to compatibility problems with volatile solvent-based mascara products, wherein the flexible discs swell when exposed to the product. The swelled discs make it difficult, if not impossible, for the discs to pass through the wiping ring of the container, thus making the package unusable.

Thus, a mascara applicator which can deliver a consistent amount of mascara product to the eyelashes, comb and separate the same lashes, and be compatible with even the most volatile of formulations is still needed.

SUMMARY OF THE INVENTION

Provided for herein is a cosmetic package and applicator which can both deliver a consistent amount of product to a consumer's eyelashes, as well as comb and separate the lashes.

This package comprises a container having a closed end, an open end, and a wall which connects the closed end to the open end thereby defining a product compartment. The open end of the container is provided with an annular extending neck which defines a passage to the product compartment. A wiper is located within the neck of the container and defines a restricted orifice. A closure, which is removably mounted on the neck portion, is then provided.

An elongated rod having a distal end and a proximal end is attached to the closure and projects into the product compartment of the container. The distal end of the rod is an applicator which is adapted to pass through the wiper so as to remove excess product from the applicator as it is withdrawn from the container. The applicator comprises an array of independent discs, each independent disc having a central aperture through which the distal end of the rod is slidably disposed. The array of independent discs are capable of sliding on the distal end of the rod between a first expanded position and a second compressed position. Each independent disc is provided with a spring. The spring biases its respective disc into the first expanded position from the second compressed position after the disc passes through the wiper.

The benefits of the aforementioned applicator are twofold. First, the compressing of the array of discs during the withdrawal of the applicator from the container allows a controlled amount of product to remain on the applicator for application by the consumer. Second, the biasing of the discs into their expanded position by the spring causes the discs to assume a configuration which allows the applicator to effectively comb and separate the eyelashes.

BRIEF DESCRIPTION OF THE DRAWINGS

Other objects, features and advantages of the present invention will become evident from the following detailed description considered in light of the drawings, wherein.

DETAILED DESCRIPTION OF THE INVENTION

Figure 1:
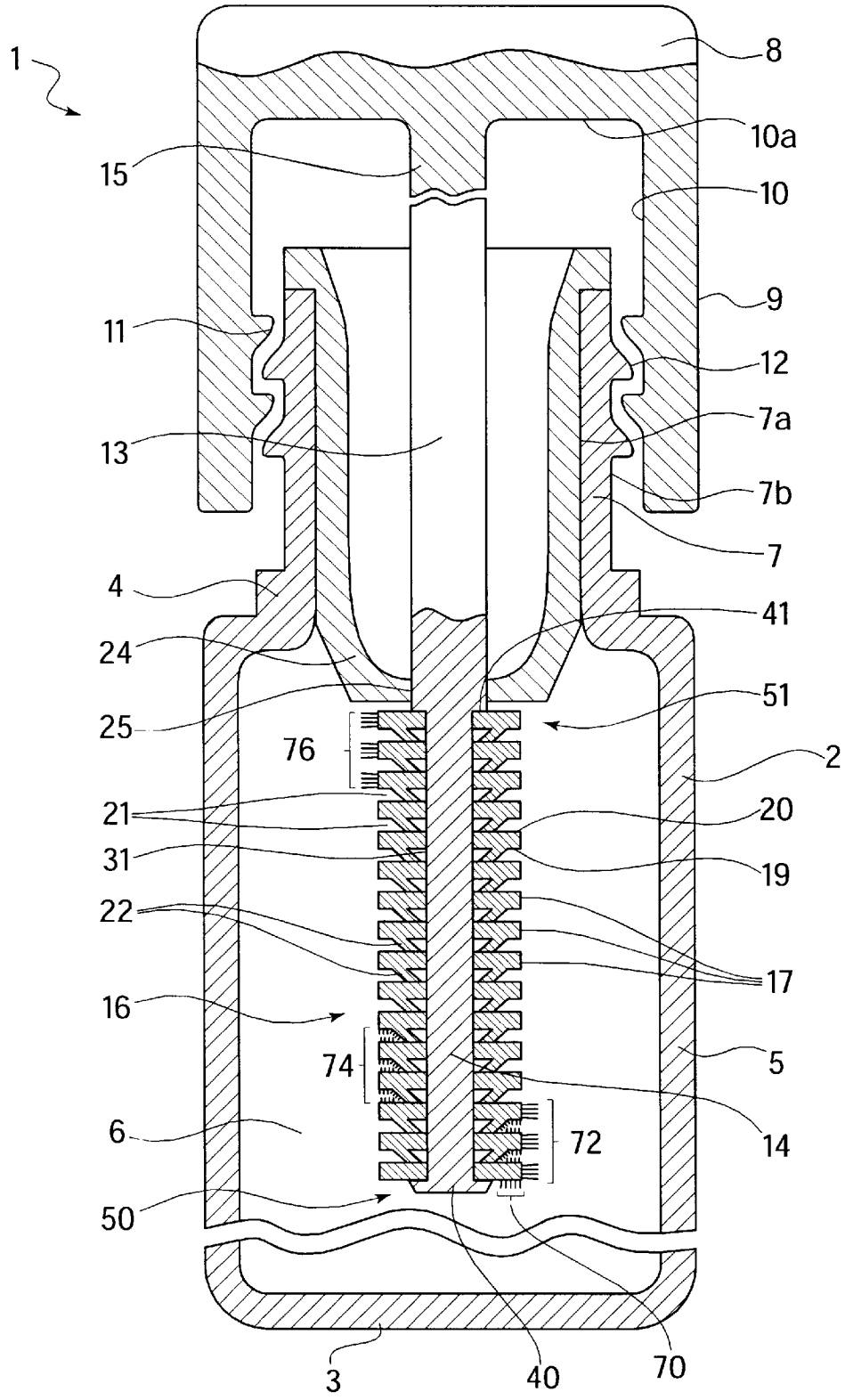
FIG. 1 is a partial cross-sectional view of the container and applicator of the present invention, wherein the applicator is in the expanded position.

Referring now to the drawings, FIG. 1 shows a partial cross-sectional view of the package of the present invention, generally referred to as 1. A container 2 is provided for housing the cosmetic product. The container 2 has a closed end 3, an open end 4, and a wall 5 which connects the closed end 3 to the open end 4 and defines a product compartment 6. The open end 4 is provided with an annular extending neck 7. The neck 7 has an inner surface 7*a* and an outer surface 7*b*. A wiper 24 is disposed along the inner surface 7*a* of the neck 7 of the container 2. The wiper 24 can be a separate piece which is inserted into the neck of the container, or the wiper can be an integrally molded ring which projects inwardly from the inner surface 7*a* of the neck 7 of the container. Regardless of which structure is chosen, the wiper 24 defines an opening 25 through which the applicator 16 passes when being inserted or withdrawn from the container. The purpose of the wiper 24 is to remove excess product from the applicator 16 before use by the consumer.

A closure 8 is provided for the container 2. The closure 8 has an outer surface 9, an inner surface 10, and an undersurface 10*a*. The closure is removably mounted about the neck 7 of the container. Preferably, and as shown in FIG. 1, the closure 8 is removably mounted about the neck 7 of the container by two sets of opposing threads, one set 11 projecting inwardly from the inner surface 10 of the closure 8, and the other set 12 projecting outwardly from the outer surface 7*b* of the neck 7. The closure can be removably mounted on the container neck by means other than the opposing threads shown and described herein, such means being well known in the art and a matter of routine modification to the disclosed structure. Such alternate means include, for example, buttress threads or lug threads.

An elongated rod 13 having a distal end 14 and a proximal end 15 is attached to the undersurface 10*a* of the closure 8 at the proximal end 15. Provided at distal end 14 of the elongated rod 13 is an applicator, generally referred to as 16, which projects into the product compartment 6. The applicator 16 is adapted to pass through the opening 25 of the wiper 24 as the applicator 16 is inserted and withdrawn from the container 2.

The applicator 16 of the present invention comprises an array of independent discs 17. Each disc 17 is made from a semi-rigid or rigid material, so that upon passage through the opening 25 of the wiper 24 the discs 17 will not flex or distort, but rather will cause the wiper to flex and allow the discs to pass therethrough. As defined herein, the term "semi-rigid material", as used with respect to the discs, is defined as any material or design which may be somewhat flexible, but will not flex when in contact with the wiper. As defined herein, the term "rigid material", as used with respect to the discs, is defined as any material or design which is substantially inflexible and will not readily flex, regardless of the material chosen for the wiper. Preferably, the material used for the discs will be rigid and non-flexible. With this in mind, it will be apparent to the skilled artisan that numerous materials can be chosen for the wiper and the discs as long as the discs are "rigid" in relation to the material chosen for the wiper.

Each material contemplated for use for the discs or the wiper will have associated with it certain parameters which will allow the disc and the wiper to have the required rigidity and flexibility, such parameters including the thickness of the material, and the molecular density of the material, to name a few, such parameters being known in the art. Preferably, however, the discs will have a shore hardness factor of about 100 or more.

Suitable materials for the disc include metals, such as, for example, aluminum and stainless steel; and plastics, such as, for example, styrene, acetal, polyethylene, polypropylene, nylon, polyvinyl chloride, polyethylene terephthlate, polycarbonate, acrylic, and the like. Suitable materials for the wiper include, for example, polyethylene, polypropylene, rubber, silicone, nylon, and the like.

Figure 6:
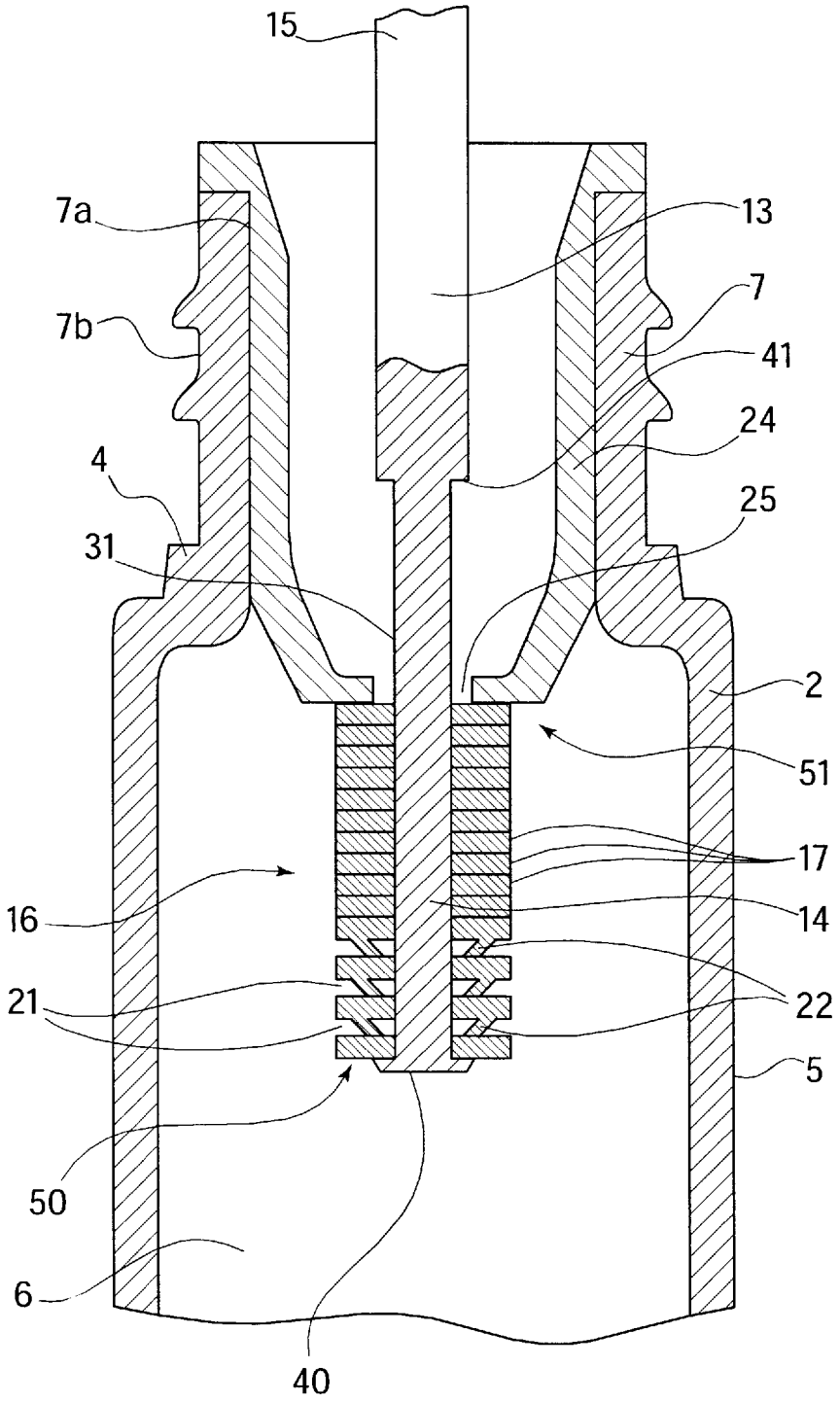
FIG. 6 is a partial cross-sectional view of the container and applicator of the present invention, wherein the applicator is in the compressed position.

As seen more clearly in FIGS. 2A–4C, each independent disc 17 has a central aperture 18 through which the distal end 14 of the rod 13 is slidably disposed. Each disc 17 has an upper surface 19 and a lower surface 20 so that, when the discs are aligned in the array, the upper surface 19 of one disc faces the lower surface 20 of the next successive disc within the array and defines a space 21 therebetween. Because each disc 17 is slidably disposed on the distal end 14 of the rod 13, each disc is free to move axially along the rod, thereby allowing the array of discs to assume a first expanded position, as seen in FIG. 1, and a second compressed position, as seen in FIG. 6.

A first stop 40 and a second stop 41 is provided for retaining the array of discs on the distal end 14 of the rod 13. The first stop 40 is located at the distal end 50 of the array and the second stop 41 is located at the proximal end 51 of the array. The first stop 40 and the second stop 41 define an area on the distal end 14 of the rod 13 within which movement of the array of discs is restricted. The first stop and the second stop can be any physical structure which creates a barrier that will not allow the discs to pass when compressed or expanded, such as, for example, relief bumps which project outwardly from the rod, or the permanent adhering of the first and last discs in the array to the rod itself, or, as shown in FIGS. 1 and 6, the area of the rod in which the discs are to be placed has a smaller diameter than that of the remaining portion of the rod thereby defining stops 40 and 41 at either end of the array which will not allow the discs to pass. It will be evident to one skilled in the art that, in order to assemble the discs onto the distal end of the rod, one of the stops must be secured to the rod after the discs are slidably disposed thereon. This can be accomplished, for example, by making the first stop a separate piece that can be fastened to the rod after the discs are in place, or by melting the end of the rod into a bulb-like configuration after the discs are in place.

Figure 2A:
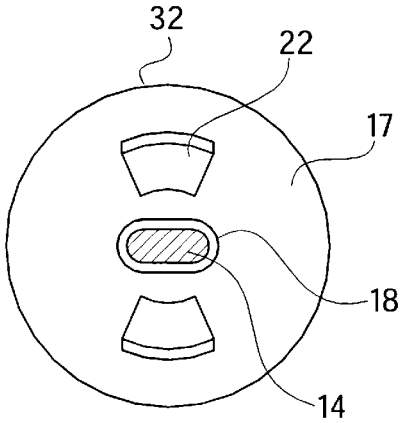
FIGS. 2A through 2E show top plan views of various shaped discs for use with the present invention.
Figure 2B:
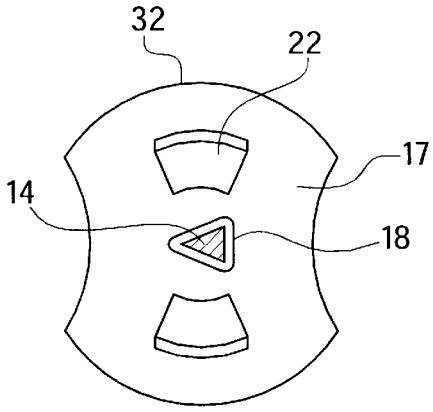
Figure 2C:
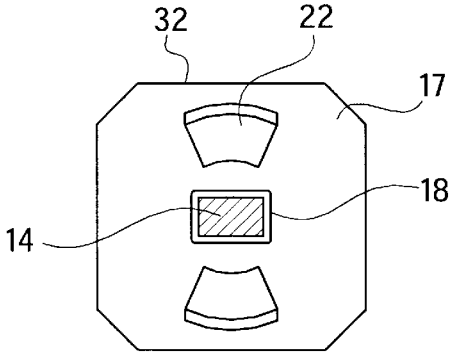
Figure 2D:
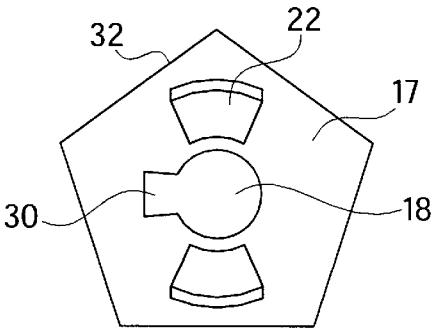
Figure 2E:
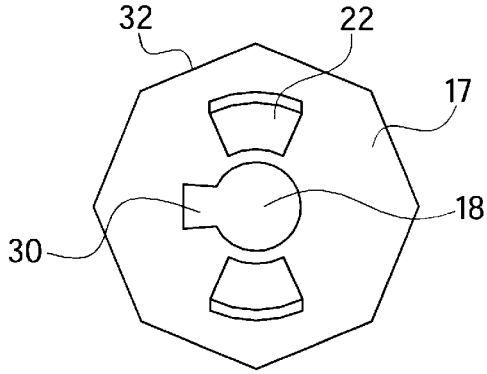

Preferably, the central aperture 18 of each disc and the distal end 14 of the rod 13 co-operate to form an index which prevents the discs from rotating about the distal end of the rod. As seen more clearly in FIG. 3D, the index is preferably a tongue and groove configuration. As shown, a groove 30 is provided off of the perimeter of the central aperture 18 of the disc 17. The groove 30 is designed to fit about a tongue 31 along the distal end 14 of the rod 13. The alignment of the tongue 31 and groove 30 prevent the disc 17 from rotating about the axis of the rod 13. Restricting the discs from rotating about the axis of the rod allows more effective separation and combing of the eyelashes because the stiffness associated with the non-rotating discs allows easier passage of the discs through the lashes when forced against them, as opposed to having the discs rotate after contact. As seen in FIGS. 2A–2C, an index can also be created by forming the distal end 14 of the rod 13 and the central aperture 18 of the discs 17 as complementary shapes such as, for example, oval, square, or triangular.

It may be desirable, however, to have all of the discs rotate after contact with the lashes if a gentler combing effect is desired. In this instance, the index will not be present. It will also be evident that, in order to provide an intermediate combing stiffness, or both stiff and gentle combing actions, it may be preferred that only some of the discs will be able to rotate about the rod. The rotatable discs may be alternated or randomly interspersed within the array, or may be arranged in distinct functional zones within the array by the limited distribution of an index to only those discs in which rotation is not desired.

Figure 3A:
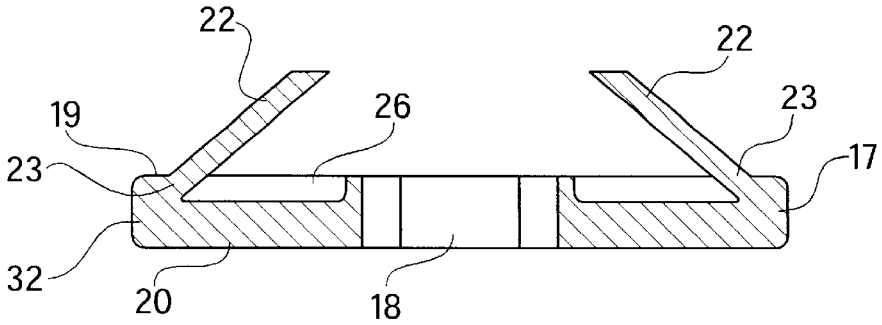
FIG. 3A is a cross-sectional view of one embodiment of the disc and spring of the present invention.
Figure 3B:
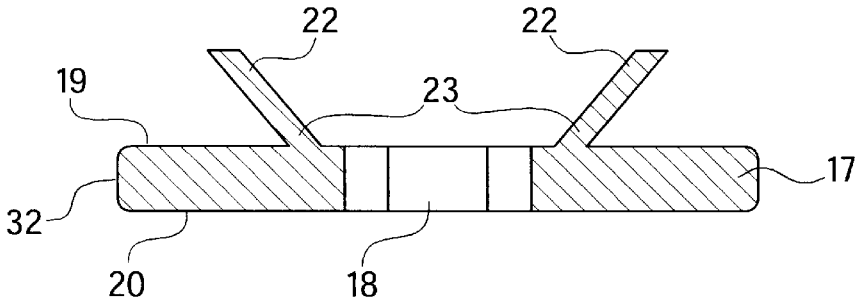
FIG. 3B is a cross-sectional view of a second embodiment of the disc and spring of the present invention.
Figure 3C:
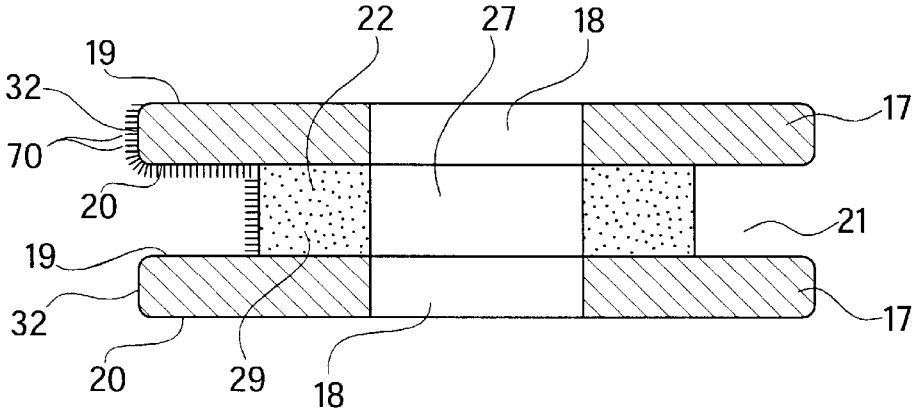
FIG. 3C is a cross-sectional view of a further embodiment of the disc and spring of the present invention.
Figure 3D:
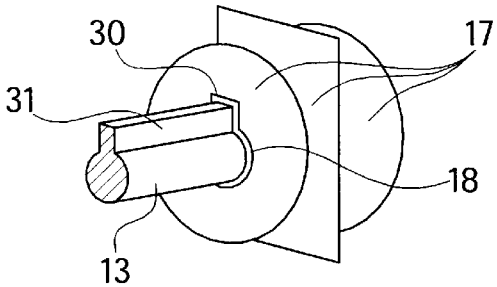
FIG. 3D is a perspective view of the discs and rod of the present invention with an index.
Figure 3E:
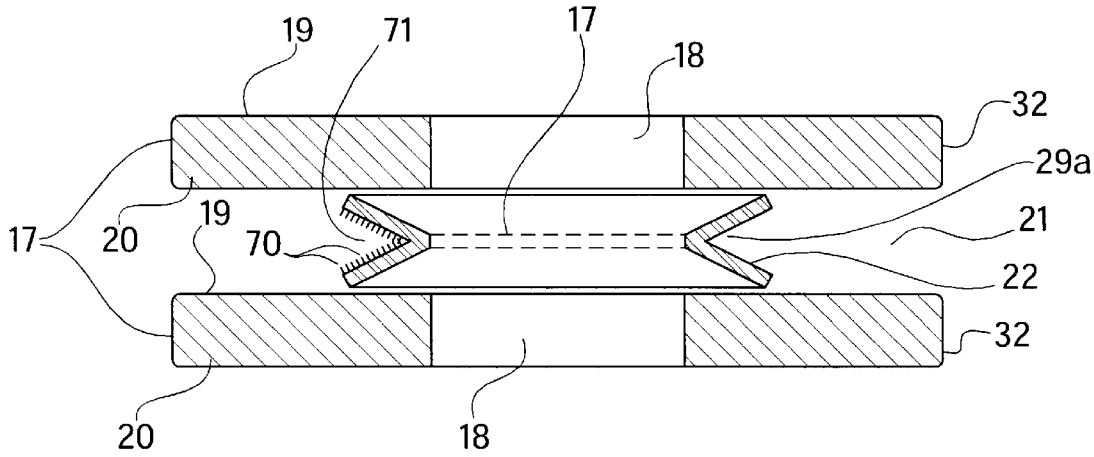
FIG. 3E is a cross-sectional view of a further embodiment of the disc and spring of the present invention.
Figure 4A:
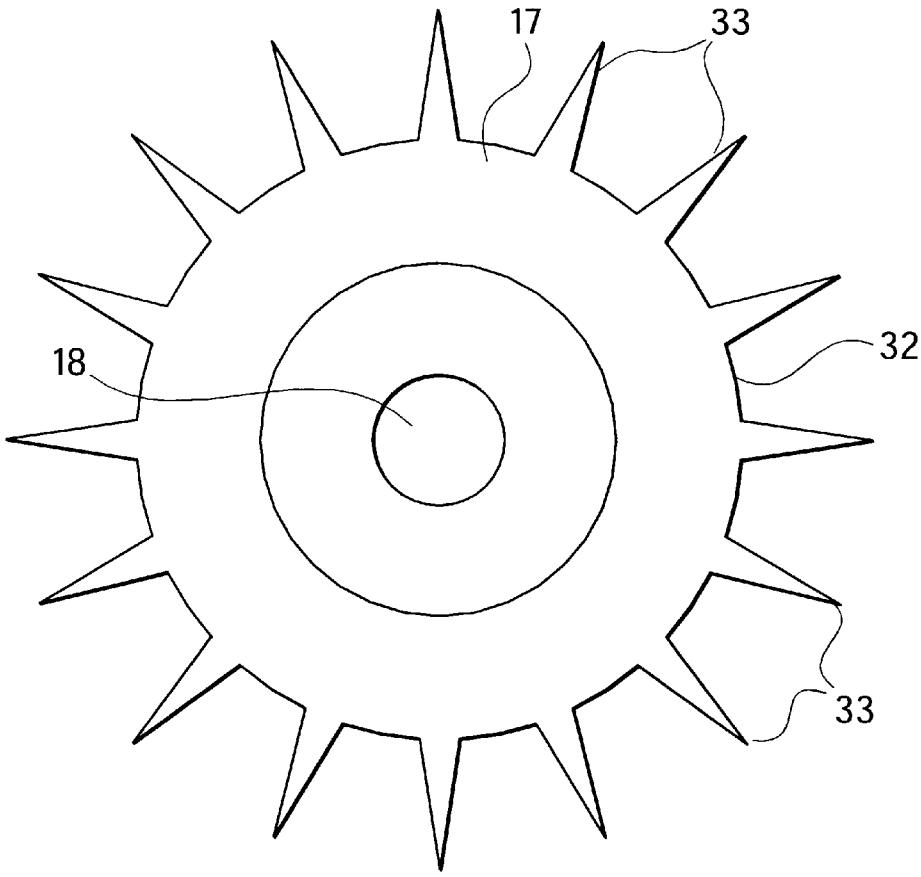
FIG. 4A is a top plan view of an additional embodiment of the disc of the present invention.
Figure 4B:
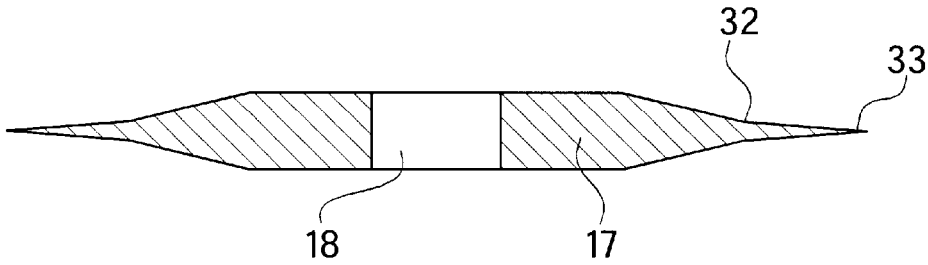
FIG. 4B is a cross-sectional view of the disc of FIG. 4A, wherein the ribs are perpendicular to the axis of the disc.
Figure 4C:
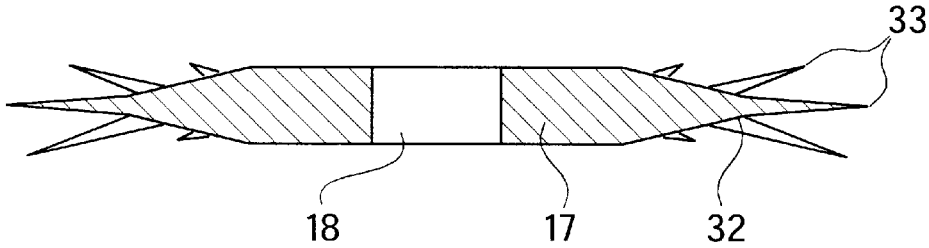
FIG. 4C is a cross-sectional view of the disc of FIG. 4A, wherein the ribs are at an angle to the axis of the disc.

As can be seen more clearly in FIGS. 2A through 4B, the shape of the perimeter 32 of the discs 17 can vary. The perimeter 32 may be, for example, circular, square, pentagonal, hexagonal, star-shaped, and the like. Also, the perimeter 32 of each disc 17, as seen more clearly in FIGS. 3B and 4B, for example, can be either formed with or without a taper. In other words, each disc can have a uniform thickness throughout the disc, or the thickness of each disc can decrease from the center of the disc towards the perimeter. In a particular embodiment, as seen in FIGS. 4A–4C, the perimeter 32 of the disc is provided with a plurality of ribs 33. The ribs 33 can project from the perimeter 32 of the disc 17 either perpendicularly relative to the axis of the disc, as in FIG. 4B, or at an angle relative to the axis the disc, as seen in FIG. 4C. The addition of the ribs along the perimeter of the disc allows for a greater combing an separating action of the applicator. Each different shape contemplated has associated with it different wiping and combing characteristics. The choice of which shape to use will be chosen based on the application characteristics desired. It will be evident that the discs comprising the applicator do not all have to be of the same shape and size, and can be mixed and matched accordingly.

Within the space 21 defined by the upper surface 19 and lower surface 20 of each opposing disc, a spring 22 is positioned. The spring 22 biases the array of discs into the first expanded position from the second compressed position. The spring can be any device which will allow the discs to be moved, with the application of a sufficient force, from the expanded position into the compressed position, and then back to the expanded position when that force is removed.

For example, as seen in FIGS. 1, 2A–2E, and 3A–3B, the spring is a resiliently flexible arm which projects either from the upper surface 19 or lower surface 20 of the disc 17. 20 Preferably, the arm is integrally molded with, and made of the same material as the disc.

When the arm and the disc are made of the same material it will be evident that, in order for the arm to be flexible and the disc to remain rigid, the arm will have a smaller cross-section at the junction 23 between the arm and the disc. The thickness of the cross-section of the arm will be determined according to the flexural properties of the material chosen for the disc, each material having associated with it certain dimensions which will allow the arm to be resiliently flexible.

The arm acts as a spring by flexing at the junction 23 of the arm and the disc 17 when the disc contacts the wiper 24 as the rod and applicator are withdrawn from the container, as shown in FIG. 6. Then, when the disc clears the wiper 24, the arm returns to its original position and thus causes the array of discs to return to their expanded position.

The degree of compression of the discs can be controlled, for example, by selecting a material and arm design that will allow the discs to compress only to a certain point, thus controlling the space between the discs and the amount of product therebetween. Also, as seen in FIG. 3A, if a greater degree of compression is required, a recess 26 is provided along the surface from which the arm projects. The recess 26 is designed to accommodate the arm when the array of discs are compressed. The recess 26 eliminates the interference created between the arm and the surface of the disc from which it extends, while the arm is flexed toward that surface, during the compression of the array of discs.

In alternate embodiments, as seen in FIGS. 3C and 3E, the spring 22 is an elastic ring 29, 29*a* having a central opening 27. The elastic ring 29, 29*a* is made of a compressible material. The central opening 27 allows each elastic ring 29, 29*a* to be slidably disposed on the distal end 14 of the rod 13 between adjacent rigid discs 17. Suitable materials for the elastic ring 29, 29*a* include plastic or rubber compounds, such as, for example, polyurethane, urethane foam, santoprene, silicone elastomers, rubbers, thermoplastic elastomers, and the like. The elastic ring 29, 29*a* acts as a spring by compressing when the disc contacts the wiper 24 as the rod and applicator are withdrawn from the container. The elastic ring 29 shown in FIG. 3C has a rectangular elevational cross-section, so that compression characteristics of the elastic ring 29 are substantially determined by the elasticity of the material and the dimensions of the cross-section. The elastic ring 29*a* shown in FIG. 3E has a V-shaped elevational cross-section that defines an outwardly opening annular channel 71. Thus, the compression characteristics of the elastic ring 29*a* shown in FIG. 3E are determined by the V-shaped cross-section, the elasticity of the material and the dimensions of the ring 29*a*. The channel 71 also increases the loading or storage capacity of the space 21 between discs 17.

In each case, as each successive disc 17 clears the wiper 24, a corresponding elastic ring 29, 29*a* returns to its uncompressed state. When sufficient elastic rings are uncompressed, the array of discs returns to its expanded position. Similar to the arm embodiment, the degree of compression of the discs can also be determined by material, shape and dimension selection. The determination of the compression will be a simple matter of selecting an elastic ring 29, 29*a* to have a material, shape and dimension with the desired compression characteristics, thus controlling the space between the discs and the amount of product therebetween.

Figure 5C:
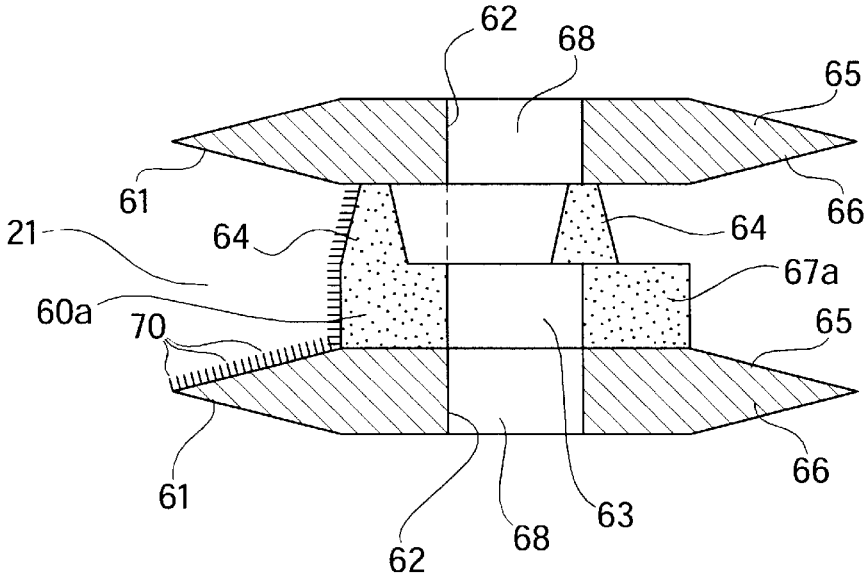
FIG. 5C is a cross-sectional view of an alternative embodiment taken along line A—A of FIG. 4A.
Figure 5A:
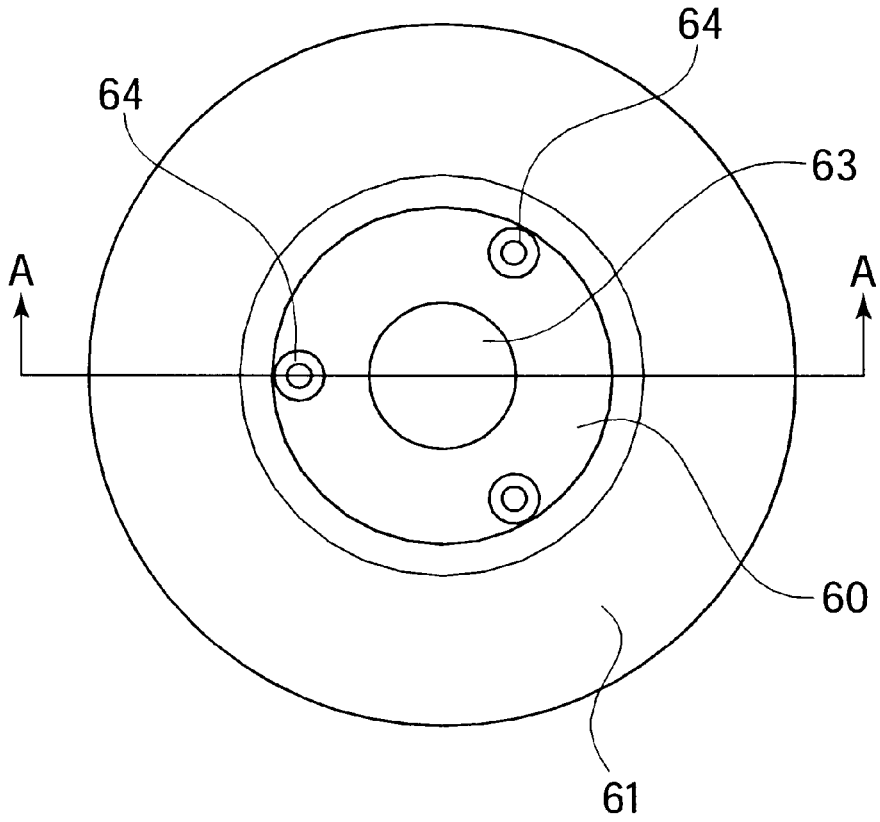
FIG. 5A is a top plan view of an additional embodiment of the disc and spring of the present invention.
Figure 5B:
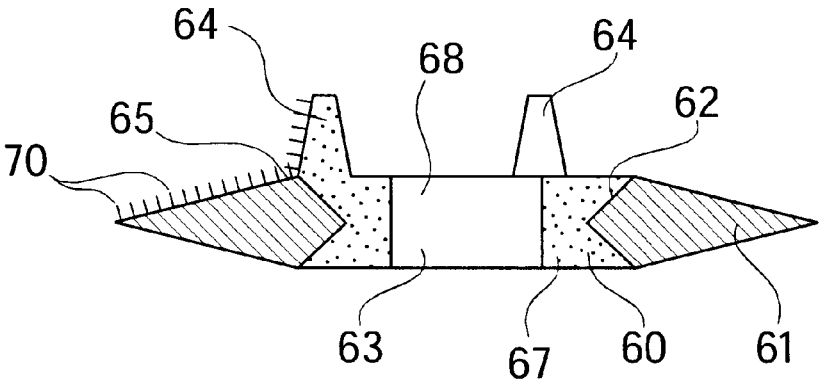
FIG. 5B is a cross-sectional view taken along line A—A of FIG. 4A.

In a further embodiment, as seen in FIGS. 5A and 5B, a spring 60 is bi-injection molded with a disc 61. The process of bi-injection molding is well known process which allows two or more materials to be substantially simultaneously injected into a single mold to obtain an integral part.

The disc 61 has a central aperture 68 defined by a wall 62. The spring 60 has a base 67 defined by and positioned within the aperture of the disc 61. The spring 60 is formed of a compressible material and has a central opening 63 in the base 67 through which the distal end 14 of the rod 13 is slidably disposed. Referring to FIG. 5C, an alternative elastomeric spring 60*a* is shown that has a base 67*a* positioned between two discs rather than being positioned coaxially within a single disc. The spring 60A may be bi-injection molded with a disc, or may be molded separately, but otherwise has the same elements as the elastomeric spring 60 shown in FIGS. 5A–5B. Preferably, the elastomeric spring 60, 60*a* is formed of an elastomeric material, such as, for example, santoprene; silicone elastomers; rubbers; thermoplastic elastomers; and the like.

In order to allow the spring 60, 60*a* to compress and expand, the spring 60, 60*a* is shaped so as to have a plurality of projections 64. The projections 64 extend upwardly from the base 67, 67*a,* i.e., upwardly relative to the upper surface 65 of the disc. The projections extend upwardly toward a lower surface 66 of the next successive disc 61. When a disc 17 contacts the wiper 24 as the rod and applicator are withdrawn from the container, at least the projections 64 of the spring 60, 60*a* compress. Then, as each successive disc clears the wiper 24, a corresponding spring 60, 60*a,* including the projections 64 returns to an uncompressed state. When sufficient springs 60, 60*a* have returned to the uncompressed state, the array of discs return to their expanded position. Similar to the previous embodiments, this embodiment allows the degree of compression of the discs to be controlled. Controlling the degree of compression will be a simple matter of selecting a material, shape and dimension suitable to achieve the desired compression characteristics, thus controlling the space between the discs and the amount of product retained therebetween. In addition to the foregoing features and elements of the applicator, the product loading, wiping and application characteristics of the array, and the separation and combing characteristics of the array can be significantly enhanced by providing fibers to the discs of the array and/or to the springs. This can be accomplished by a flocking process as described, for example, in U.S. Pat. No. 4,527,575 to Vasas, incorporated herein by reference. Basically, fibers having a suitable length, thickness, product compatability, etc., are electrostatically charged, and provided to selected components of the applicator by way of an electrical field. Adhesive applied to selected surfaces of the components anchors the fibers perpendicularly to the surface in desired locations. The selected components can be flocked in this way either before or after assembly of the applicator. Alternatively, to avoid the use of adhesives, the flocking process can be integrated into the production process for the components of the applicator by providing the electrostatically charged fibers to a component before a selected surface of the component is fully cured. Subsequent curing of the component surface will anchor the fibers perpendicularly in the surface. This method of flocking may be particularly suited for discs and/or springs made from curable thermoplastic resins or elastomers.

As noted, the fibers may be applied to selected components, i.e., discs, springs, and/or to selected surfaces of selected components, i.e., the perimeter of the disc, the upper and/or lower surface of the disc, the outwardly directed surfaces of the disc or spring. Referring to FIG. 1, flocked fibers 70 are shown in exemplary configurations. In the configuration shown generally at 72, the fibers cover substantially all exposed surfaces of the discs 17 and springs 22. At reference number 74, an exemplary configuration is shown wherein fibers are only provided to surfaces directed into the spaces 21 between discs. And in an exemplary configuration shown at 76, fibers are shown only at the perimeter of the discs. It will be understood that the fibers may be applied to all or part of any of the embodiments of the disc or spring components discussed herein, (see, for example, FIGS. 3C, 3E, 5B and 5C), and in any combination of configurations. Because the discs 17 of the applicator 16 move with respect to each other, e.g., when the array is drawn through the wiper, on an applicator made according to this disclosure including flocked fibers, product loading can be particularly well controlled, especially in the spaces 21 between discs.

The benefits of the aforementioned applicator are twofold. First, the compressing of the discs during the withdrawal of the applicator from the container allows a controlled amount of product to remain on the applicator for application by the consumer. Second, the biasing of the discs into their expanded position by the spring causes the discs to assume a configuration which allows the applicator to effectively comb and separate the eyelashes.

When the consumer inserts the applicator into the product compartment of the container, the product is deposited onto the applicator, and in particular, within the spaces defined by the upper surface and lower surface of each successive disc within the array. Then, when the consumer withdraws the applicator from the container, the applicator, and the product deposited thereon, contacts the wiper. When the applicator contacts the wiper, the array of discs are compressed, thereby decreasing the space between each disc and squeezing out a certain amount of product from between the discs. The amount of product remaining between the discs is directly proportional to the degree in which the discs are allowed to compress, i.e., the more the discs compress, the smaller the amount of product remaining within the spaces of the array, and the less the discs compress, the larger the amount of product remaining. The degree of compression will be a matter of choice as to how much product will be sufficient for the intended application.

Next, as the applicator passes through the wiper, the excess product on the applicator, and that which was squeezed out from between the discs, is scraped off. Then, after the applicator is wiped of excess product, the spring biases the array of discs into their expanded position. This causes the spaces between each disc to open to their original distance, thus causing the applicator to assume a toothed configuration which can comb and separate eyelashes effectively.

The present invention is not limited to the specific details shown and described; rather, various modifications may be made to the preferred embodiments described above without departing from the scope of the invention, which is limited only by the following claims.

What is claimed is:

1. A cosmetic package comprising:

a container having a closed end, an open end, and a wall connecting the closed end to the open end, said wall and closed end defining a product compartment;

a neck extending annularly from the open end of the container, said neck having an inner surface and an outer surface;

a closure having an outer surface, an inner surface, and an underside, said closure removably mounted about the neck of the container;

an elongated rod having a distal end and a proximal end, said proximal end attached to the undersurface of the closure;

an applicator provided at the distal end of the rod and adapted to pass through the neck of the container and into the product compartment, said applicator comprising;

an array of independent discs, each disc having a central aperture through which the distal end of the rod is slidably disposed, each disc having an upper surface and a lower surface, said upper surface of one disc facing the lower surface of the next successive disc when the discs are aligned in the array, the opposed upper surface and lower surface of each successive disc defining a space therebetween, said array of discs having a distal end and a proximal end and being capable of assuming a first expanded position and a second compressed position;

a first stop attached to the distal end of the rod at the distal end of the array;

a second stop attached to the rod at the proximal end of the array, the first stop and the second stop defining an area on the rod within which movement of the array of discs is restricted; and a plurality of springs for biasing the array of discs into the first expanded position from the second compressed position, at least one of the plurality of springs positioned between each disc and a next successive disc in the array of discs, at least one of the plurality of springs is a resiliently flexible arm which projects either from the upper surface or the lower surface of the disc; and a wiper located within the neck of the container, said wiper defining an opening adapted to remove excess product from the array of discs as the applicator passes through the neck of the container.

2. The cosmetic package of claim 1 wherein a recess is provided in the surface from which the flexible arm projects, said recess accommodating the arm when the array of discs are in the compressed position.

3. A cosmetic package comprising:

a container having a closed end, an open end, and a wall connecting the closed end to the open end, said wall and closed end defining a product compartment;

a neck extending annularly from the open end of the container, said neck having an inner surface and an outer surface;

a closure having an outer surface, an inner surface, and an underside, said closure removably mounted about the neck of the container;

an elongated rod having a distal end and a proximal end, said proximal end attached to the undersurface of the closure;

an applicator provided at the distal end of the rod and adapted to pass through the neck of the container and into the product compartment, said applicator comprising;

an array of independent discs, each disc having a central aperture through which the distal end of the rod is slidably disposed, said array of discs having a distal end and a proximal end and being capable of assuming a first expanded position and a second compressed position;

a first stop attached to the distal end of the rod at the distal end of the array;

a second stop attached to the rod at the proximal end of the array, the first stop and the second stop defining an area on the rod within which movement of the array of discs is restricted; and a plurality of springs for biasing the array of discs into the first expanded position from the second compressed position, at least one of the plurality of springs positioned between each disc and a next successive disc in the array of discs and at least one of the plurality of springs further comprising a base with a central opening and a plurality of compressible projections extending upwardly from the base; and a wiper located within the neck of the container, said wiper defining an opening adapted to remove excess product from the array of discs as the applicator passes through the neck of the container.

4. The cosmetic package of claim 3 wherein the base and the projections are made from an elastomeric material chosen from the group consisting of santoprene, silicone elastomers, rubbers, and thermoplastic elastomers, and the base is bi-injection molded within the central aperture of the disc.

5. A cosmetic applicator comprising:

an elongated rod having a distal end and a proximal end;

an array of independent discs, each disc having a central aperture through which the distal end of the rod is slidably disposed, each disc having an upper surface and a lower surface, said upper surface of one disc facing the lower surface of the next successive disc when the discs are aligned in the array, the opposed upper surface and lower surface of each successive disc defining a space therebetween, said array of discs having a distal end and a proximal end and being capable of assuming a first expanded position and a second compressed position;

a first stop attached to the distal end of the rod at the distal end of the array;

a second stop attached to the rod at the proximal end of the array, the first stop and the second stop defining an area on the rod within which movement of the array of discs is restricted; and a plurality of springs, at least one of the plurality of springs positioned between each disc and a next successive disc in the array of discs, at least one of the plurality of springs is a resiliently flexible arm which projects either from the upper surface or the lower surface of the disc, the plurality of springs biasing the array of discs into the first expanded position from the second compressed position.

6. The cosmetic applicator of claim 5 wherein a recess is provided along the surface from which the arm projects, said recess accommodating the arm when the array of discs are in the compressed position.

7. A cosmetic applicator comprising:

an elongated rod having a distal end and a proximal end;

an array of independent discs, each disc having a central aperture through which the distal end of the rod is slidably disposed, said array of discs having a distal end and a proximal end and being capable of assuming a first expanded position and a second compressed position;

a first stop attached to the distal end of the rod at the distal end of the array;

a second stop attached to the rod at the proximal end of the array, the first stop and the second stop defining an area on the rod within which movement of the array of discs is restricted; and a plurality of springs, at least one of the plurality of springs positioned between each disc and a next successive disc in the array of discs, at least one of the plurality of springs comprising a base with a central opening and a plurality of compressible projections extending upwardly from the base, the plurality of springs biasing the array of discs into the first expanded position from the second compressed position.

8. The cosmetic applicator of claim 7 wherein the base and projections are an elastomeric material, and the base is bi-injection molded within the central aperture of the disc.

9. The cosmetic applicator of claim 8 wherein the elastomeric material is chosen from the group consisting of santoprene, silicone elastomers, rubbers, and thermoplastic elastomers.

* * * * *